US005279248A

United States Patent [19]

Blachford

[11] Patent Number: 5,279,248

[45] Date of Patent: Jan. 18, 1994

[54] KAYAK RIGHTING METHOD AND APPARATUS

[76] Inventor: Alistair M. Blachford, 4460 West 11th Avenue, Vancouver, B.C., Canada, V6R 2M3

[21] Appl. No.: 871,631

[22] Filed: Apr. 20, 1992

Related U.S. Application Data

[63] Continuation-in-part of Ser. No. 617,212, Nov. 23, 1990, abandoned.

[51] Int. Cl.[5] ..... B63B 43/14

[52] U.S. Cl. ..... 114/347; 114/360

[58] Field of Search ..... 114/347, 360; 441/41, 441/42, 80, 52–94, 88, 129, 127

[56] References Cited

U.S. PATENT DOCUMENTS

| | | | |
|---|---|---|---|
| 2,012,742 | 8/1935 | Evenden et al. | 441/80 |
| 2,390,199 | 12/1945 | Walsh | 9/2 |
| 3,121,888 | 2/1964 | Morgan et al. | 9/3 |
| 3,547,165 | 12/1970 | Butterworth | 141/330 |
| 3,733,180 | 5/1973 | Heineck et al. | 23/281 |
| 4,097,241 | 6/1978 | Garner et al. | 23/281 |
| 4,524,885 | 6/1985 | Zimmerly | 222/5 |
| 4,838,196 | 6/1989 | Ingram | 114/347 |
| 4,850,296 | 7/1989 | Slanker et al. | 114/343 |
| 5,098,325 | 3/1992 | Kim et al. | 441/88 |

*Primary Examiner*—Sherman Basinger
*Attorney, Agent, or Firm*—Klarquist, Sparkman, Campbell, Leigh & Whinston

[57] ABSTRACT

The present invention provides a method and an apparatus for reducing the skill required of a paddler to right a capsized kayak without exiting it, and to thus avoid the dangers associated with exiting a kayak after capsize. In broad terms, the paddler is provided with a simple and rapid means of creating a buoyant force to one side of the capsized kayak, which can be used to produce a generous amount of torque for righting. More specifically, an inflatable flotation device is held in place on the deck of the kayak and is provided with a handle. Upon capsize the paddler grasps and pulls the handle, whereupon the flotation element is released from its securing container and automatically inflated from compressed gas cartridges. The paddler can then lean on the handle and attached flotation element to right the kayak without exiting it.

16 Claims, 7 Drawing Sheets

KAYAK RIGHTING METHOD AND APPARATUS

This application is a continuation-in-part of application Ser. No. 07/617,212 filed Nov. 23, 1990 and now abandoned.

The invention relates to kayaking safety accessories and techniques, and more particularly to a method and an apparatus for righting a capsized kayak while remaining seated in it.

BACKGROUND OF THE INVENTION

The kayak, originally designed by the Inuit of northern Canada as a fast and seaworthy hunting craft for the Arctic waters, has become a popular recreational boat. It currently takes one of two basic forms, either that of the white water kayak designed for running rivers, or the sea kayak. The former is generally shorter and of low volume for maneuverability. The latter is longer and of higher volume to provide greater directional stability and allow for the stowage of cargo. Sea kayaking has become a very popular recreational activity, as it is a pleasant way to enjoy the outdoors, and a convenient way to travel to remote campsites.

In kayaks of both types the paddler is sealed into the boat by a waterproof "skirt" worn around the waist and sealed around the lip of the cockpit in which the paddler sits. The skirt prevents water from entering the kayak even when the kayak is overturned. An overturned kayak may be righted by the paddler without removing the skirt by performing a skill-requiring maneuver called an "Eskimo roll" (or simply "roll"). To do a roll, the paddler applies sufficient torque using correct orientation and movement of the paddle to rotate the boat and his or her body to an upright position. If the paddler is unable to right the boat using the Eskimo roll, but a second boat is near, a rescue can be performed in which the second boat is brought close enough to the capsized boat so that the capsized paddler's waving hand can grasp its bow. The capsized paddler can use the support of the second boat's bow to rotate him- or herself to an upright position without exiting his/her boat. A paddler unable to right the kayak can free him- or herself from the boat (by releasing the skirt from the cockpit rim) and slip out of the cockpit while underwater.

Sea kayaks rarely capsize, and so sea kayakers are generally less experienced in performing an Eskimo roll than are white-water kayakers. However, if a sea kayaker fails to right the boat and it becomes necessary to release the skirt and exit the boat, he/she is confronted by a number of life-threatening dangers. The kayaker may become separated from the boat and/or paddle, possibly far from shore and possibly in rough seas. The temperature of the water will often be low enough to reduce the paddler's strength over a fairly short time, and make re-entry to the boat more difficult. This serious situation can lead to hypothermia and/or drowning, and fear or panic can further complicate the situation. Even if the paddler succeeds in re-entering the boat it will be filled with water, unstable, and liable to re-capsize before it can be emptied. Consequently the preferred response to a capsize is righting the boat without the paddler exiting the boat.

Prior art exists for the prevention of capsize. However, such devices necessarily alter handling and performance characteristics of the kayak and, should they fail to prevent capsize, they may hinder immediate righting of the kayak.

Various prior art aids to the paddler in the event of capsize exist, but these have concentrated on aiding re-entry after exiting the boat rather than righting the boat without exiting it. For example, one device provides a paddle float which is inflated and secured to one blade of the paddle. The other end of the paddle is then fastened to the boat deck behind the cockpit. The paddle then functions as an outrigger to stabilize the kayak as the paddler attempts re-entry. Another emergency aid simply consists of a large, orally inflatable bag upon which the paddler sits or leans to aid re-entry. It takes many minutes to inflate. Both of these devices have the disadvantage of subjecting the paddler to the dangers noted above which are associated with exiting the boat.

There is therefore a need for a method and/or device which, requiring little skill or practice, enables a paddler to right an overturned kayak without exiting the kayak. The righting of a kayak and paddler requires the generation of torque about the long axis of the kayak. The skill requirement in the Eskimo roll lies in minimizing the required torque, and in generating the resulting torque requirement from specific orientation and movement of a paddle blade. The fundamental idea of the present invention is to provide kayakers with a simple and rapid means of creating a buoyant force to one side of the kayak, which can be used to produce a generous amount of torque for righting.

It is an object of the invention to provide a method by which a paddler can accomplish results equivalent to those of the skill requiring maneuver, the Eskimo roll. It is another object of the invention to provide, for such a method, an apparatus which is quickly and easily deployable upon capsize and which provides a buoyant force that a kayaker can use to rotate the kayak and to raise his/her body back to an upright position, in the same way that he/she could use the bow of a rescue boat.

SUMMARY OF THE INVENTION

The present invention reduces the skill required of a paddler to right a capsized kayak without exiting it, and to thus avoid the dangers associated with exiting a kayak after capsize. In accordance with a broad aspect of the invention, the paddler is provided with a simple and rapid means of creating a buoyant force to one side of the capsized kayak, which can be used to produce a generous amount of torque for righting.

According to an aspect of the invention, a method for righting a capsized kayak provides the paddler with a handled, rapidly self-inflating means for flotation. The flotation means, after inflation, has a minimum volume of one cubic foot, and is adapted for positioning to one side only of the kayak, spaced from the kayak, and for movement in an arc of at least 90 degrees about the kayak by means of force applied to the handle. After capsize the handle of the flotation means is grasped by a hand of the paddler, and the flotation means is inflated and located to one side of the kayak, spaced from the kayak. Sufficient force is then applied to the handle to rotate the kayak and paddler to an upright position. Preferably, in an initial step, the paddle in use by the paddler is placed in one hand, prior to the grasping of the handle of the flotation means with the other hand, so that the paddle is retained for immediate seaworthiness upon righting. According another aspect of the invention, in a variation of this method for righting, inflation of the flotation means may be actuated before the handle is grasped.

According to a further aspect of the invention, an apparatus for aiding an occupant in righting a capsized kayak comprises an inflatable means for flotation and means for non-orally inflating the flotation to a volume of at least one cubic foot in less than ten seconds. The apparatus comprises a handle connected to said flotation means which is adapted for grasping by a hand and maintaining a hand within one foot of the flotation while sufficient force is applied to the handle to submerge the flotation means. Action of a hand in continual grasp with the handle of the apparatus can actuate inflation, or release the flotation to a position spaced from the hull, or both. After inflation, the flotation means of the apparatus can be positioned to one side only of the hull of the kayak, spaced from the hull, and moved by force exerted on the handle in an arc of at least 90 degrees about the hull. According to a still further aspect of the invention the apparatus may further comprise a means for holding the inflatable flotation in relation to the kayak.

BRIEF DESCRIPTION OF THE DRAWINGS

In drawings which illustrate a preferred embodiment of the invention.

DETAILED DESCRIPTION OF A PREFERRED EMBODIMENT

Figures 1, 2, 3, 4, 5, 6, 7:
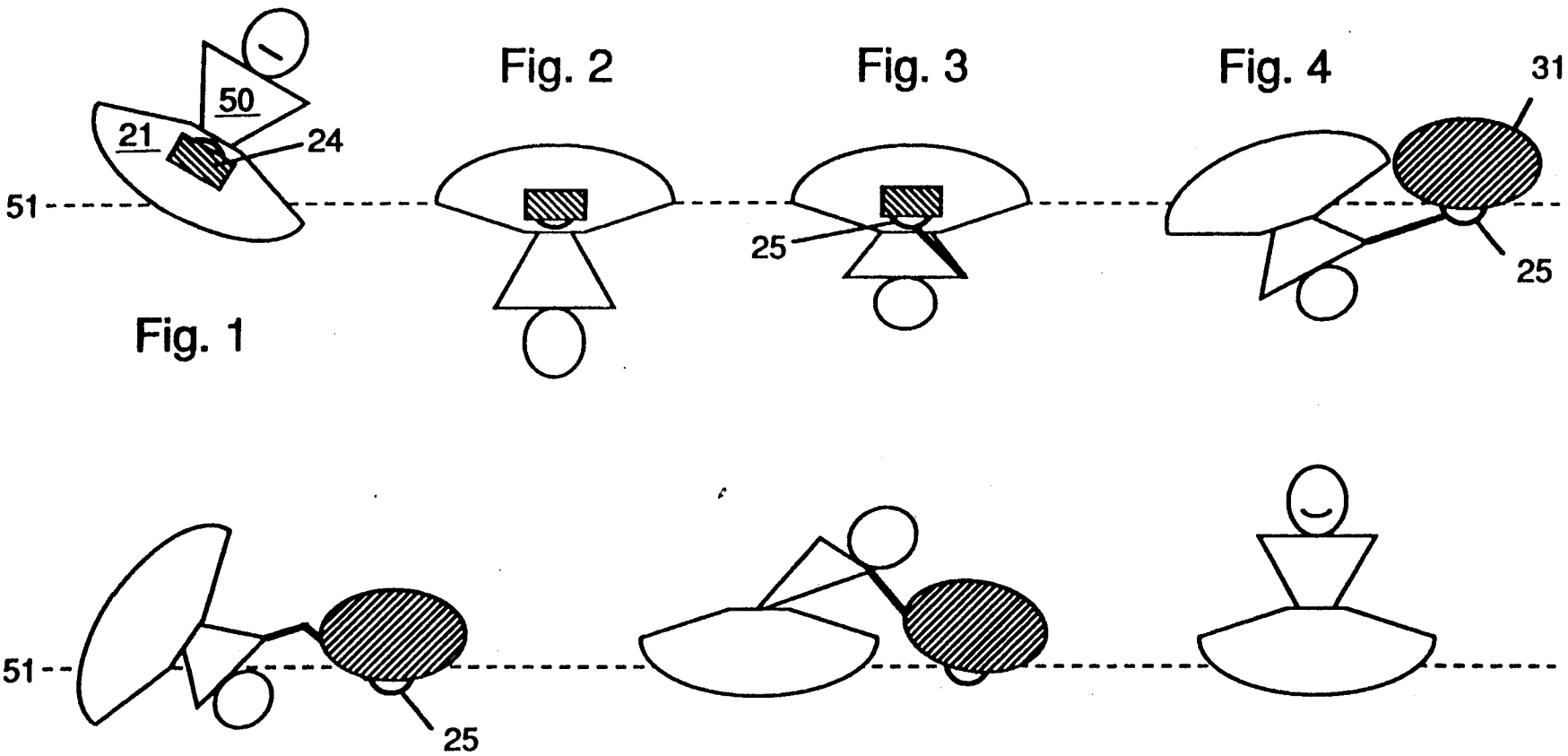
FIGS. 1 through 7 are a series of sequential views showing schematically the sequence of actions taken when using the invention to right a capsized kayak.

The method of the invention may be understood with reference to FIGS. 1 through 7. Paddler 50 is seated in the kayak 21 with skirt (not shown) in place. The surface of the water is indicated at 51. The paddler is provided with inflatable means for buoyant support 24, preferably attached to the deck of the kayak in front of the cockpit. The properties of a preferred embodiment of apparatus 24 are described below. In FIG. 2 the kayak has capsized, with the paddler upside down in the water but still in the boat. As shown in FIG. 3, to right himself the paddler first reaches for the apparatus 24 and grasps its handle 25. Inflation of the apparatus is then actuated in device-specific manner, and the paddler locates the apparatus to one side of the kayak, spaced from the hull, as pictured in FIG. 4. The paddler then leans on handle 25 of the buoyant support (FIG. 5), thus generating the torque to rotate the boat to an upright position (FIG. 6) and sit up (FIG. 7).

As will be apparent to those skilled in the art, various modifications and adaptations of the method described above may be made without departing from the spirit of the invention. If the paddler were to retain hold of his/her paddle with one hand, while grasping the handle of the apparatus with the other hand, upon completion of the righting the functional equivalent of the skill-requiring Eskimo roll would be accomplished, and the paddler and kayak would be immediately seaworthy. If the provided apparatus were to automatically inflate upon inversion of the kayak, or if inflation were triggered by the paddler in a separate initial action, it would be possible for inflation to precede the grasping of the handle of the apparatus and the release of the apparatus, from its place of securement, to a position spaced from the hull.

Figure 8:
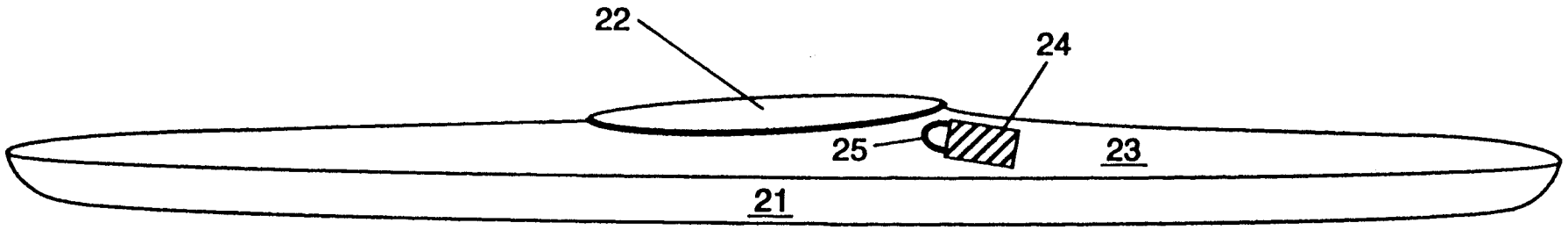
FIG. 8 is a side perspective view of the apparatus of the invention in stowed condition on the deck of a kayak.
Figure 9:
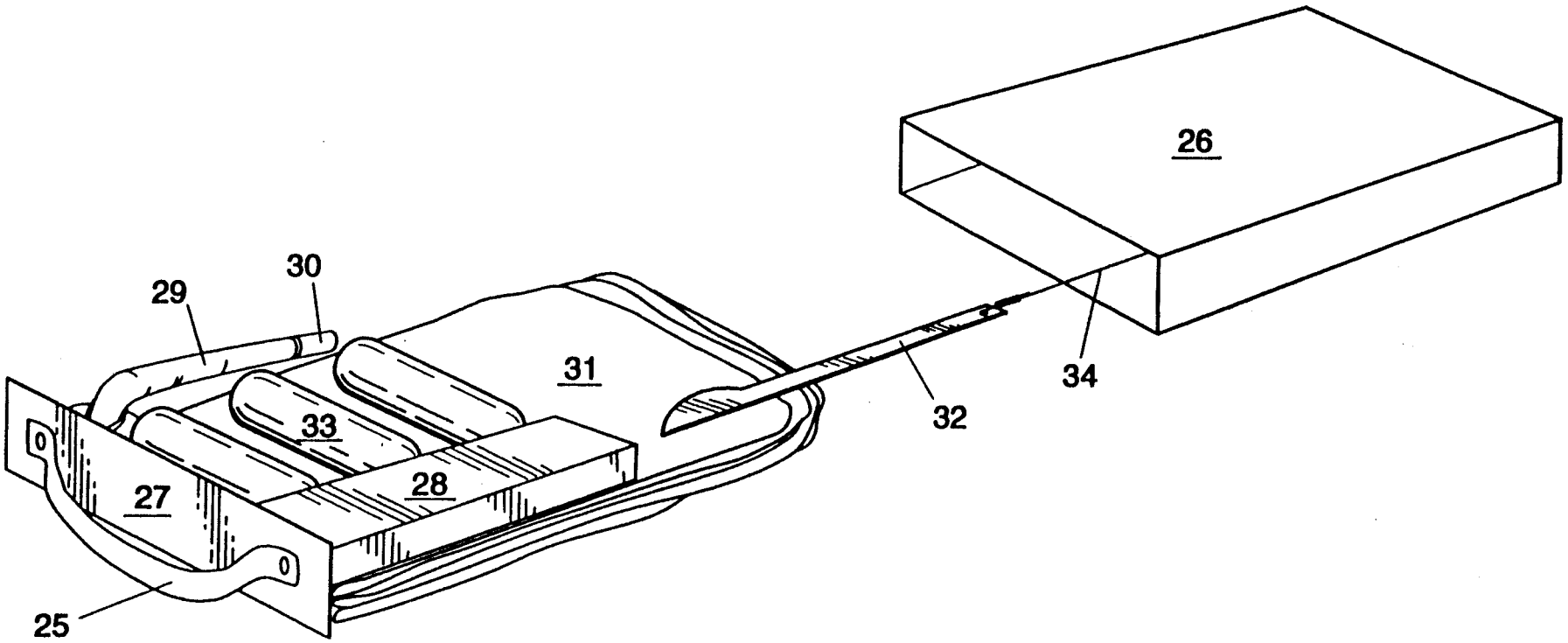
FIG. 9 is a perspective view of the apparatus of the invention pulled from its cover to expose the inflatable bag and inflation mechanism.

With reference to FIG. 8, a kayak 21 has a cockpit 22 and a deck 23. The apparatus of the invention is designated at 24 with protruding handle 25. As shown in FIG. 9, the components of apparatus 24 are contained in hollow shell 26 and lid 27. Shell 26 is firmly secured to deck 23. Shell 26 and lid 27 close with a watertight seal, to protect the contents from weathering agents such as sunlight and salt water. In this embodiment, shell 26 and lid 27 are formed of a rigid plastic material or the like.

Handle 25 is connected through lid 27 to detonator block 28 and oral inflation nozzle 29. Detonator block 28 and nozzle 29, in turn, are connected to inflatable bag 31. Pulling handle 25 separates lid 27 from shell 26 and slides out the inflatable bag and its means of inflation.

Figure 12:
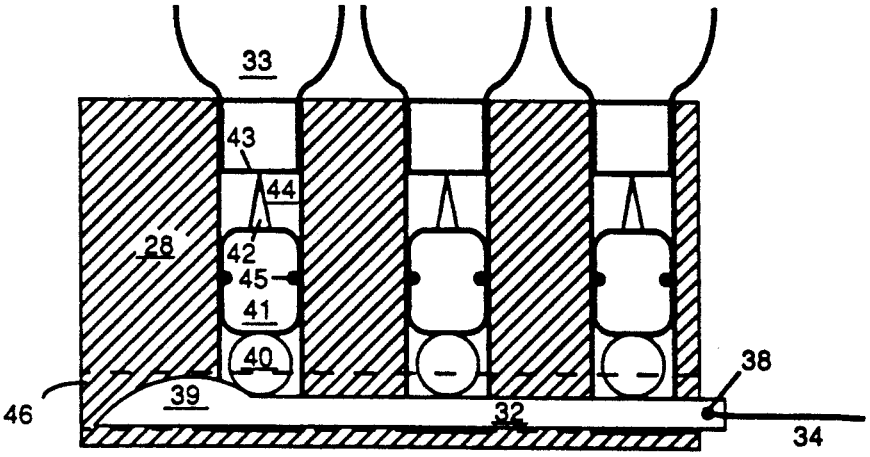
FIGS. 12, 13 and 14 are cross-sectional views of the inflation mechanism in various operating positions taken along lines XIII—XIII of FIG. 15.
Figure 13:
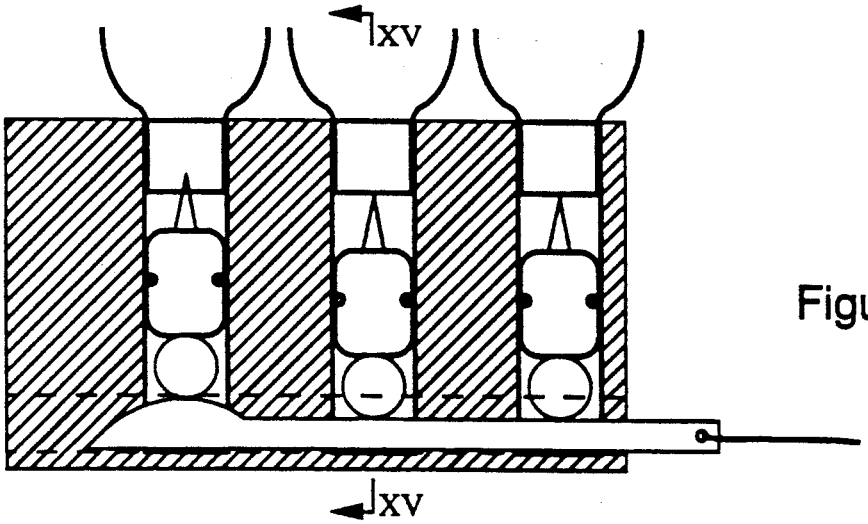
Figure 14:
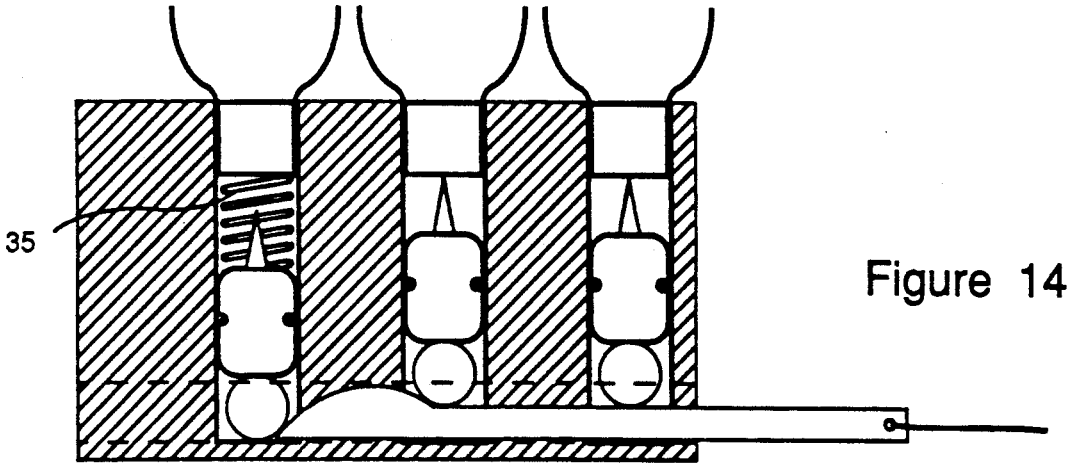

Bag 31 is automatically inflated upon removal from shell 26 due to the action of slider 32 on gas cartridges 33, as explained below using FIGS. 12 through 14. In normal operation slider 32 is securely attached by tether 34 either to cover 26 or to boat deck 23, so that removal of bag 31 from cover 26 causes slider 32 to be withdrawn from detonator block 28, thus discharging gas cartridges 33. Each cartridge communicates through a passageway in the detonator block and a one-way valve with the interior of bag 31.

Oral inflation valve 29 can be opened or closed by rotation of cap 30 either to deflate bag 31 after use, or to orally inflate bag 31 to allow a person to rehearse aspects of the use of the apparatus without expending cartridges, or to inflate bag for use as a re-entry aid should the cartridge become empty, or inoperative.

Figure 10:
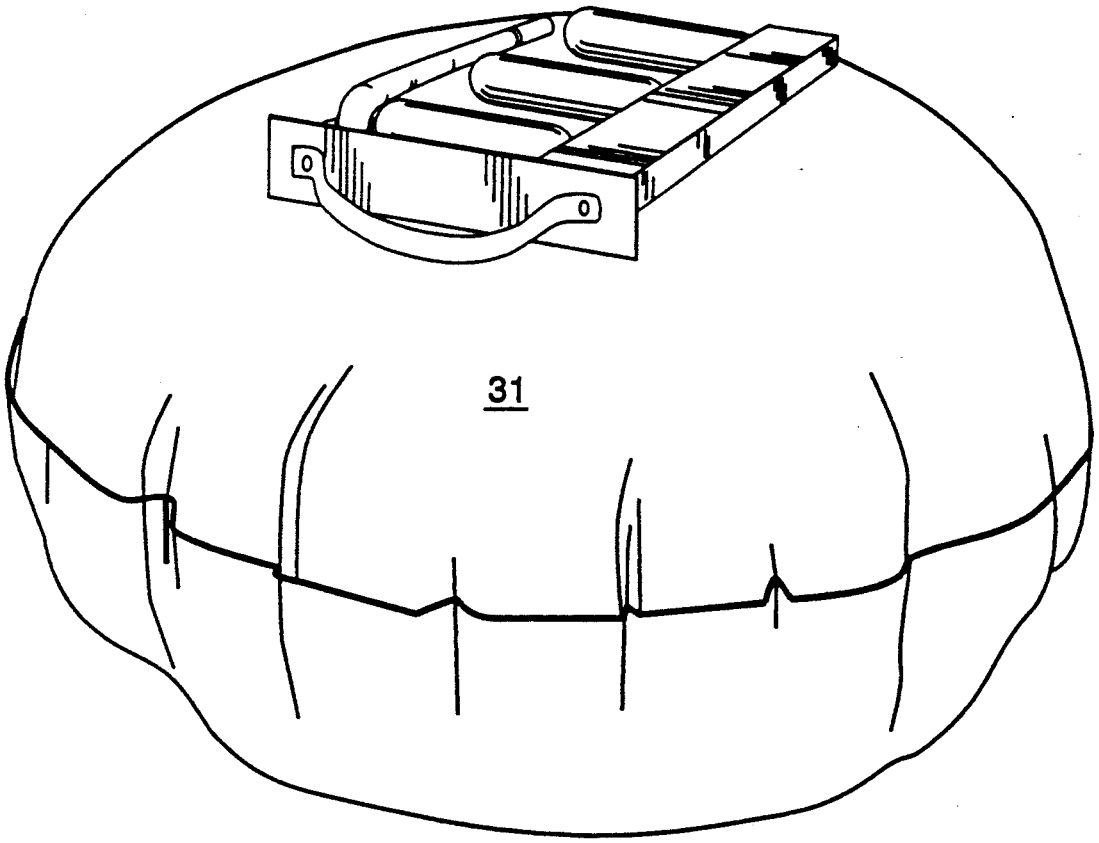
FIG. 10 is a perspective view of the apparatus shown in FIG. 9 after inflation of the bag.
Figure 15:
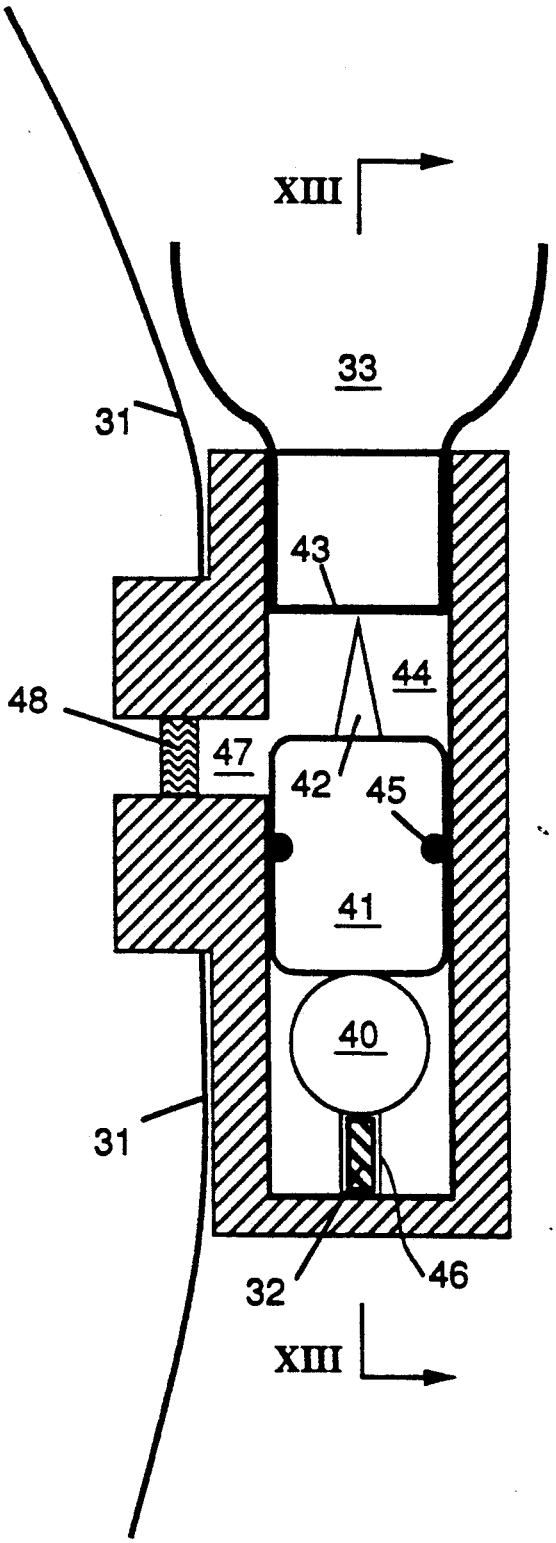
FIG. 15 is a cross-sectional view of the inflation mechanism taken along lines XV—XV of FIG. 13.

Bag 31, shown in inflated condition in FIG. 10, is an airtight, waterproof, collapsible, flexible, cushion-shaped container. Preferably, it is constructed of lightweight, durable, and rot-resistant material such as MYLAR (TM). It has a volume of at least one cubic foot, and preferably about two cubic feet, to provide sufficient flotation when inflated. It is preferably secured to the detonation mechanism around the gas outlet passageways 47 (FIG. 15).

The operation of the preferred inflation mechanism can be best understood with reference to FIGS. 12, 13, 14 and 15. A slider 32 has eye 38 at one end and lateral protrusion 39 at the other end. Slider 32 is tethered by tether 34 from eye 38 to cover 26 or boat deck 23. When detonator block 28 is pulled away from cover 26, slider 32 is withdrawn along a slot 41 in detonator block 28. Shown in FIG. 13, as the slider is withdrawn, slider protrusion 39 causes ball-bearings 40 to move pistons 41 with attached spikes 42 into puncturing contact with the seals 43 of cartridges 33. As the slider is removed, gas and/or spring pressure (see spring 35 shown by way of example in FIG. 14) then forces pistons 41 to the other end of chambers 44. See FIG. 15. O-rings 45 prevent the gas from escaping out the slider slot 46. The gas flows instead through passageways 47 and one-way valves 48 into bag 31. To be useful to an anxious capsized kayaker, whose head is submerged, the inflation means should inflate the bag to an operational volume of at least one cubic foot, and preferably about two cubic feet, in less than ten seconds.

Some important features of the apparatus may be clearly identified by reviewing FIGS. 2 through 7. In FIG. 2 the kayak has capsized, with the paddler upside down in the water but still in the boat. The paddler may be surprized, confused or disoriented. Invention 24 is stowable in a conveniently accessible location, and handle 25 is easy to locate and grasp. As shown in FIG. 3, the capsized paddler first reaches for the invention 24 and grasps handle 25. He pulls the handle toward him, which slides bag 31 from the shell. As the bag is removed from the cover, the slider is withdrawn from the detonator block, which triggers the release of gas from the cartridges as explained above with reference to FIGS. 12 through 14. Actuation is accomplished without requiring the paddler to release his grasp or locate other features of the apparatus or the boat. Operation is simple and "one-grab". Since the paddler's head is submerged, inflation is non-oral and rapid. Since the paddler may not have had a full breath at time of capsize and the situation is stressful, inflation to operable size should take place in under ten seconds, and more rapid inflation is preferable. As shown in FIG. 4, bag 31 then floats to the surface of the water at one side of the boat. The bag must be movable to one side of the boat because it is onesided buoyant force that produces the torque for righting. The paddler then leans on the floating bag (FIG. 5), using handle 25 for gripping, rotates the boat to the upright position (FIG. 6), and sits up (FIG. 7). For efficiency in applying downward force to buoyant bag 31, the bag is movable to a position spaced from the hull. The bag is easiest to lean on when it is roughly the same distance from the hull as the paddler's shoulder. A bag volume of two cubic feet was found by experimentation to provide a generous buoyant force for righting even a large paddler in a loaded boat. Some smaller bag volumes are functional, but may require that the bag be held at greater distance from the hull in order to generate the required torque. As bag volume decreases, the required skill level increases (due to a need to reduce the torque requirement by using a "hip-flick" and other Eskimo roll components) to the point where a volume of one cubic foot is of little use as an aid to the righting process. Bag 31 must be movable in an arc about the long axis of the kayak hull. As shown in FIGS. 4 through 6, the bag moves in an arc of approximately 180 degrees. The flotation means of such an apparatus must be movable in at least 90 degrees of arc, in which case the inverted kayaker would raise the inflated bag directly overhead and let the buoyant rise of the bag to the surface rotate the kayak through the first 90 degrees of righting. The invention floats the paddler's hand as high in the water as possible while downward force is being applied to handle 25. To be effective, the apparatus must float the paddler's hand at a depth less than an arm's length from the surface. Therefore handle 25 is constructed so as to maintain the paddler's hand in close proximity, less than one foot, to the buoyant bag 31 while a downward force equal to the entire buoyant force of the bag is applied. After righting, inflated bag 31 can be deflated using valve 29 and stowed, or trailed in the water on a tether while still inflated.

Figure 11:
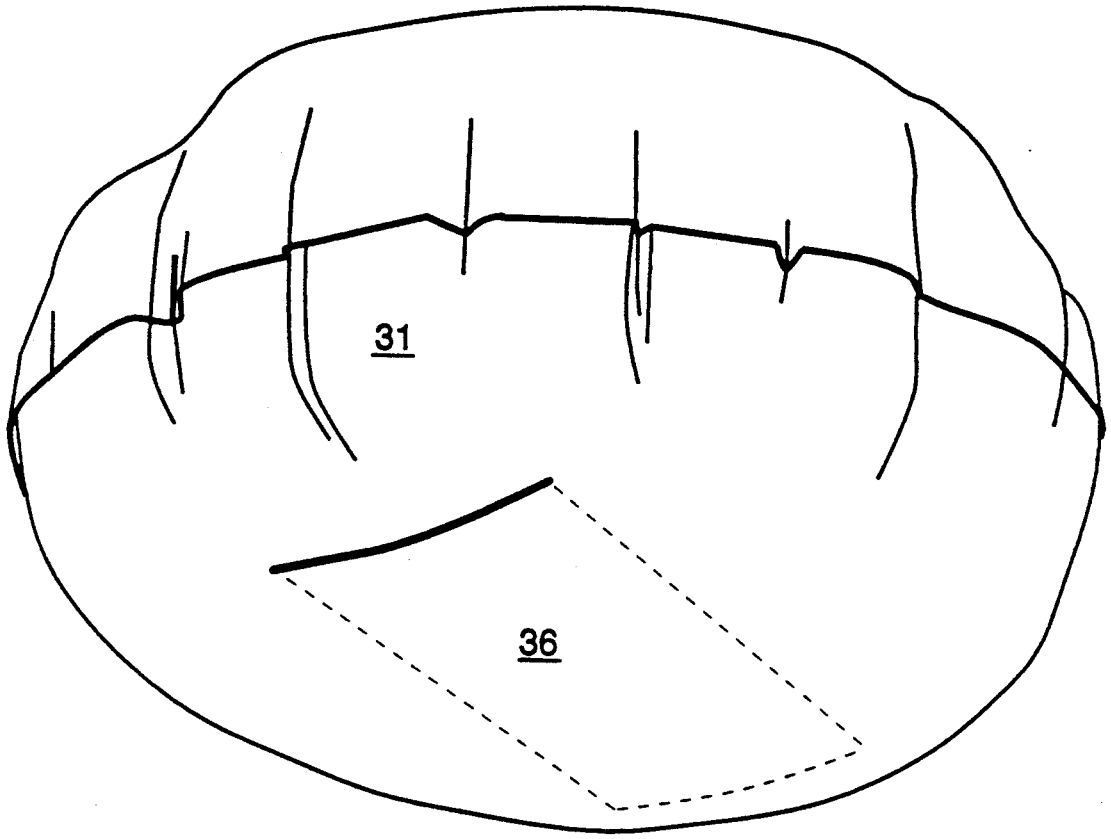
FIG. 11 is a perspective view from below, of the apparatus shown in FIG. 10, to display the underside of the inflated bag.

In the event that the paddler is forced to exit the boat, whether due to accident, panic, or turbulence, the invention can still be deployed and used to assist the paddler back into the boat. FIG. 11 shows pocket 36 on the underside of bag 31. A paddle blade can be slid into pocket 36, so that the righting aid can be used as a paddle float, in the manner of the prior art device described above.

As will be apparent to those skilled in the art, various modifications and adaptations of the apparatus described above may be made without departing from the spirit of the invention, the scope of which is to be construed in accordance with the accompanying claims, while the invention has been described for use in conjunction with kayaks, it will be apparent that it will also be useful with covered canoes and related water craft. Also, while the invention has been described as secured to the deck of the kayak, it could obviously be held in, and used from, any readily accessible place including any location or recess or pocket on the external surface of the kayak, on the sprayskirt or spraydeck of the kayak, or on the clothing or equipment worn by the paddler. For example, shell 26 could be strapped to the deck, sprayskirt or other equipment by means of grommets, straps, hook and pile fastener strips or the like. Shell 26 could be dispensed with completely if the invention were constructed of sufficiently durable, weather and water resistant materials. It should also be apparent that the preinflation volume of the invention should be minimized to avoid interference with routine operation of the kayak.

What is claimed is:

1. A method by means of which an occupant of a capsized kayak may right the kayak, said kayak having a hull, comprising:

a) providing inflatable means for buoyant support comprising:

i) inflatable means for flotation having a volume when inflated of at least one cubic foot, and adapted for positioning to one side only of said kayak hull, spaced from said kayak hull, when inflated;

ii) means for rapidly inflating said flotation means to a volume of at least one cubic foot; and iii) handle means connected to said flotation means, adapted for grasping by a human hand and adapted for transferring force to said flotation means device from a point proximate to said flotation means:

wherein said flotation means is adapted to be movable, relative to said hull, after inflation, by means of force exerted by said handle means, in an arc of at least 90 degrees relative to said hull;

b) grasping said handle means;

c) inflating said flotation means;

d) locating said flotation means to one side of said hull, spaced from said hull; and e) applying sufficient force to said handle means to rotate said kayak to an upright position.

2. Apparatus for aiding an occupant in righting a capsized kayak, said kayak having a hull, comprising:

a) inflatable means for flotation having a volume when inflated of at least one cubic foot, and adapted for positioning to one side only of said hull, spaced from said hull, when inflated;

b) handle means connected to said flotation means, adapted for i) grasping by a human hand, and for ii) transferring force to said flotation device from a point proximate to said flotation device;

c) means for rapidly inflating said flotation means to a volume of at least one cubic foot; and d) actuating means for actuating said means for inflating through action of a human hand in continual grasp with said handle means;

wherein said flotation means is adapted to be movable, after inflation, by means of force exerted by said handle means, in an arc of at least 90 degrees about said hull.

3. The apparatus of claim 2 wherein said flotation means has a volume of approximately two cubic feet when inflated.

4. The apparatus of claim 2, further comprising valve means for deflating said flotation means.

5. The apparatus of claim 2, further comprising means for orally inflating said flotation means.

6. The apparatus of claim 2, further comprising means for attaching a paddle to said flotation means.

7. The apparatus of claim 2, further comprising valve means for deflating and orally inflating said flotation means, and means for attaching a paddle to said flotation means.

8. Apparatus for aiding an occupant in righting a capsized kayak, said kayak having a hull, comprising:

a) inflatable means for flotation having a volume when inflated of at least one cubic foot, and adapted for positioning to one side only of said hull, spaced from said hull, when inflated;

b) means for rapidly inflating said flotation means to a volume of at least one cubic foot;

c) handle means connected to said flotation means, adapted for i) grasping by a human hand, and for ii) transferring force to said flotation means from a point proximate to said flotation means; and d) means for holding said flotation means in relation to said kayak, adapted so that action of a human hand in continual grasp with said handle means is sufficient to release said flotation means to a position spaced from said hull of said kayak;

wherein said flotation means is adapted to be movable relative to said hull, after inflation, by means of force exerted by said handle means, in an arc of at least 90 degrees relative to said hull.

9. The apparatus of claim 8, further comprising valve means for deflating said flotation means.

10. The apparatus of claim 8, further comprising means for orally inflating said flotation means.

11. The apparatus of claim 8, further comprising means for attaching a paddle to said flotation means.

12. The apparatus of claim 8, further comprising valve means for deflating and orally inflating said flotation means, and means for attaching a paddle to said flotation means.

13. The apparatus of claim 2 further comprising means for holding said flotation means in relation to said kayak, adapted so that action of a hand in continual grasp with said handle means is sufficient to release said flotation means to a position spaced from said hull of said kayak.

14. An apparatus as claimed in claim 13, further comprising valve means for deflating and orally inflating said flotation means, and means for attaching a paddle to said flotation means.

15. An apparatus as claimed in claim 13, wherein said means for inflating comprises:

a) a cartridge of compressed gas with a perforable seal;

b) puncturing means having a sharp point for puncturing said seal, and adapted to be movable to a position to puncture said seal;

c) means for biasing said puncturing means in a direction away from said seal; and d) a slidable triggering element adapted to move in relation to said puncturing means and thereby cause said puncturing means to move into said puncturing position.

16. An apparatus as claimed in claim 15, wherein said means for inflating comprises a body to which said cartridge is secured, in which a chamber is formed containing said puncturing means and said biasing means, in which a channel is formed for guiding the movement of said triggering element, and along which said triggering element is moved to initiate inflation.

* * * * *

UNITED STATES PATENT AND TRADEMARK OFFICE

CERTIFICATE OF CORRECTION

PATENT NO. : 5,279,248

DATED : Jan. 18, 1994

INVENTOR(S) : Alistair M. Blachford

It is certified that error appears in the above-identified patent and that said Letters Patent is hereby corrected as shown below:

Column 4 line 60, reference numeral "41" should read --46--.

Column 6 line 48, delete "device".

Column 7 lines 1 and 2, "device" should read --means--.

Signed and Sealed this

Second Day of August, 1994

*Attest:*

Bruce Lehman

BRUCE LEHMAN

*Attesting Officer*

*Commissioner of Patents and Trademarks*